US006811449B2

(12) United States Patent
Yamashita

(10) Patent No.: US 6,811,449 B2
(45) Date of Patent: Nov. 2, 2004

(54) CIRCUIT BOARD CONNECTOR AND METHOD OF ASSEMBLING IT

(75) Inventor: Kazunori Yamashita, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/611,762

(22) Filed: Jul. 1, 2003

(65) Prior Publication Data

US 2004/0009685 A1 Jan. 15, 2004

(30) Foreign Application Priority Data

Jul. 12, 2002 (JP) ..... 2002-204151

(51) Int. Cl.[7] ..... H01R 13/41
(52) U.S. Cl. ..... 439/733.1
(58) Field of Search ..... 439/78, 252, 571, 439/572, 606, 656, 658, 660, 682, 758, 733.1

(56) References Cited

U.S. PATENT DOCUMENTS 5,263,880 A * 11/1993 Schwarz et al. ..... 439/733.1
5,921,788 A * 7/1999 Wilson et al. ..... 439/78
5,980,325 A * 11/1999 Horchler ..... 439/660
6,663,442 B1 * 12/2003 Helster et al. ..... 439/751

FOREIGN PATENT DOCUMENTS

JP 61-60486 4/1986

* cited by examiner

*Primary Examiner*—Renee Luebke
(74) *Attorney, Agent, or Firm*—Gerald E. Hespos; Anthony J. Casella

(57) ABSTRACT

A PCB connector (10) has a housing (11) with a receptacle (14) that has a rear wall (12). The rear wall (12) has through holes (30) that provide communication between the inside and the outside of the receptacle (14). Recesses (31) are formed at receptacle ends of the through holes (30). Terminal fittings (20) are introduced through the through holes (30) from the outside of the housing (11). Chips (34) produced by the abrasion of the terminal fittings (20) and the inner walls of the through holes (30) stay in the recesses (31) and do not interfere with a mating connector.

10 Claims, 7 Drawing Sheets

CIRCUIT BOARD CONNECTOR AND METHOD OF ASSEMBLING IT

BACKGROUND OF THE INVENTION

1. Field of the Invention

The invention relates to a circuit board connector and to a method of assembling it.

2. Description of the Related Art

Japanese Unexamined Utility Model Publication No. 61-60486 and FIG. 8 herein disclose a circuit board connector that is mountable on a circuit board. With reference to FIG. 8, the connector has a housing 1 made of synthetic resin and a receptacle for receiving a mating connector. Substantially L-shaped terminal fittings 2 are arranged to penetrate the housing 1. One end of each terminal fitting 2 projects into the receptacle while the other end projects out of the housing 1.

This type of connector is produced by inserting the terminal fittings 2 through insertion holes to provide communication between areas inside and outside the receptacle. Each terminal fitting 2 is pressed into the through hole and fixed by a frictional force between the terminal fitting 2 and the inner wall of the through hole. The terminal fittings 2 are pressed into the through holes and are abraded against the inner walls of the through holes. Thus, the inner walls may be scratched and produce chips. Plating is applied to the terminal fittings 2 to achieve a satisfactory electrical connection with a mating connector. However, some plating may be scraped off by the friction between the terminal fittings 2 and the inner walls of the through holes. As a result, the terminal fittings 2 typically are inserted into the through hole from the receptacle side. Thus, there has been no problem caused by the chips since the chips on the inner walls of the through holes are discharged to the outside of the connector housing 1 through the insertion holes open to the outside of the connector housing 1.

A recent demand for a simplified production process now requires terminal fittings 2 to be inserted from outside the housing 1 into the receptacle. However, chips scratched off by the insertion of the terminal fittings 2 in this opposite direction now are discharged into the receptacle. The chips can be squeezed between the mating connector and the surface of the receptacle. Thus, the mating connector and the circuit board connector cannot be connected at a proper position. In an extreme case, this may lead to a contact error between the mating terminals.

The invention was developed in view of the above problem and an object thereof is to provide a circuit board connector that prevents a connection error with a mating connector.

SUMMARY OF THE INVENTION

The invention relates to a circuit board connector with a housing that has a receptacle for receiving a mating connector. Through holes extend through a rear wall of the receptacle and provide communication between areas inside and outside the receptacle. The connector further includes terminal fittings that are introduced through the through holes from the outside towards the receptacle of the housing. The rear wall of the receptacle is formed with recesses by widening at least part of the inner peripheral surfaces of the through holes. Thus, even though the terminal fittings are inserted from the rear side of the housing to the inside of the receptacle, the chips stay in the recesses and do not enter the receptacle. As a result, a connection error with the mating connector and a contact error between mating terminals resulting from the chips squeezed between the mating connector and the receptacle are prevented.

At least one bulge may bulge out in widthwise direction at a connection leg of each terminal fitting and projects from the housing. The bulge can be fit into a circuit board. Thus, the circuit board connector can be fixed to and electrically connected with a printed circuit board by inserting the connection legs into mount holes in the printed circuit board. As a result, operation steps such as soldering become unnecessary and the operation is more efficient.

The terminal fitting preferably comprises one or more pressing portions for engaging and biting into the through hole. Accordingly, the terminal fittings can be held easily and efficiently be in the housing.

The front of each pressing portion, as seen in an inserting direction, preferably is slanted. Accordingly, the slanted front guides the terminal fittings substantially to a proper position so that operational efficiency is improved.

The through holes preferably are substantially in the centers of the corresponding recesses.

The terminal fittings may comprise stoppers for engaging stopper receiving portions of the housing to stop the insertion of the terminal fittings into the through holes. Insertion of the terminal fittings can be stopped appropriately, thereby improving their positioning with respect to the housing.

A front portion of the terminal fittings as seen in an inserting direction preferably has outer dimensions smaller than the corresponding inner dimensions of the through holes and plating preferably is applied to the front portion. Accordingly, the plating will not be scratched or damaged during the insertion of the terminal fitting into the through holes.

A connecting leg of the terminal fitting projects back from the connector housing and preferably is bent at an angle to the inserting direction.

The invention also relates to a method of assembling a circuit board connector. The method comprises providing a housing having a receptacle into which a mating connector can be fit. A wall of the receptacle of the housing has through holes that provide communication between the inside and the outside of the receptacle. The method then comprises mounting terminal fittings into the housing by introducing the terminal fittings through the through holes from the outside of the housing. The wall of the receptacle is formed with recesses by widening at least part of the inner peripheral surfaces of the through holes.

At least one bulge preferably bulges out in width direction at a connection leg of each terminal fitting that projects from the housing. The bulge then is inserted into a circuit board.

The mounting step preferably comprises a step of bringing pressing portions of the terminal fitting into engagement with the through hole so that the pressing portions bite into the through hole.

The insertion of the terminal fittings preferably is guided by a slanted front part of the pressing portions as seen in an inserting direction.

The insertion of the terminal fittings into the through holes preferably is stopped by bringing stoppers on the terminal fittings into engagement with corresponding stopper receiving portions of the housing.

These and other features and advantages of the invention will become more apparent upon reading the following description of preferred embodiments and accompanying drawings. Even though embodiments are described separately, single features may be combined to additional embodiments.

DETAILED DESCRIPTION OF THE PREFERRED EMBODIMENTS

A printed circuit board (PCB) connector according to a first embodiment of the invention is identified by the numeral 10 in FIGS. 1 to 6. The connector 10 is to be mounted on a printed circuit board (not shown). In the following description, a mating side with a mating connector (left side in FIG. 1) is referred to as front side concerning forward and backward directions and reference is made to FIG. 1 concerning the vertical direction.

Figure 4:
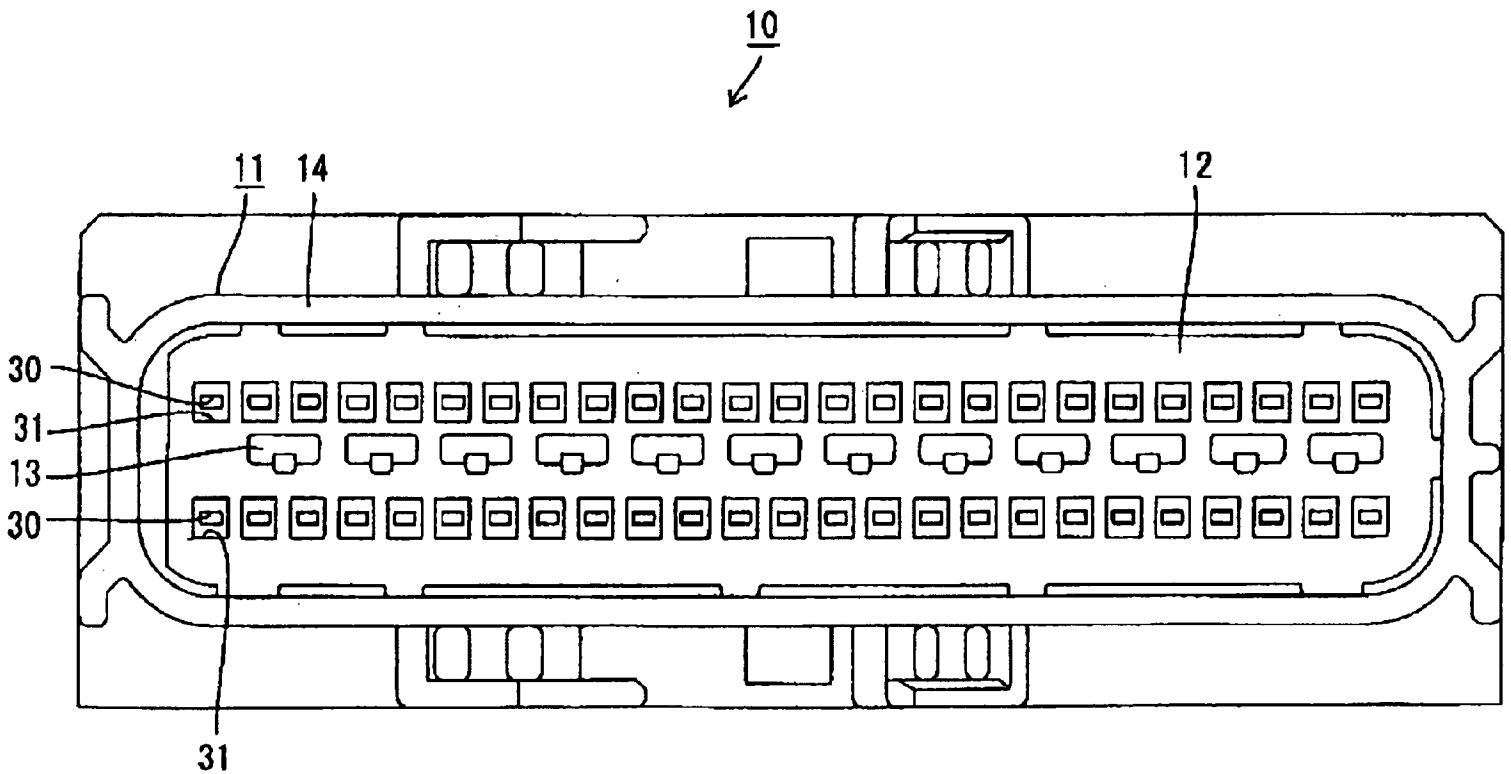
FIG. 4 is a front view of a connector housing showing the state before the terminal fittings are inserted through the through holes.

The PCB connector 10 has a housing 11 e.g. made of a synthetic resin and formed with a receptacle 14 into which a mating connector (not shown) can be fit. As shown in FIG. 4, insertion holes 30 of substantially rectangular lateral cross section are arrayed in upper and lower stages in a back wall 12 of the receptacle 14 and provide communication between the inside and the outside of the receptacle 14.

Forcible connection preventing tabs 13 project from the bottom wall 12 between the insertion holes 30 at the neighboring upper and lower stages and guide the insertion of the mating connector (not shown) and the PCB connector 10.

Rectangular recesses 31 are formed by widening inner peripheral surfaces of the through holes 30A adjacent the surface of the bottom wall 12 that faces the inside of the receptacle 14. The through holes 30 are substantially in the centers of the corresponding recesses 31. An opening of each through hole 30 made in the rear surface of the bottom wall 12 is widened along the widthwise direction of the insertion hole 30 to form a stopper receiving portion 33 (see FIG. 5), and a slanted guiding surface 35 is formed at the lower side of this opening for guiding the terminal fitting 20 into the insertion hole 30 (see FIG. 3).

Figure 5:
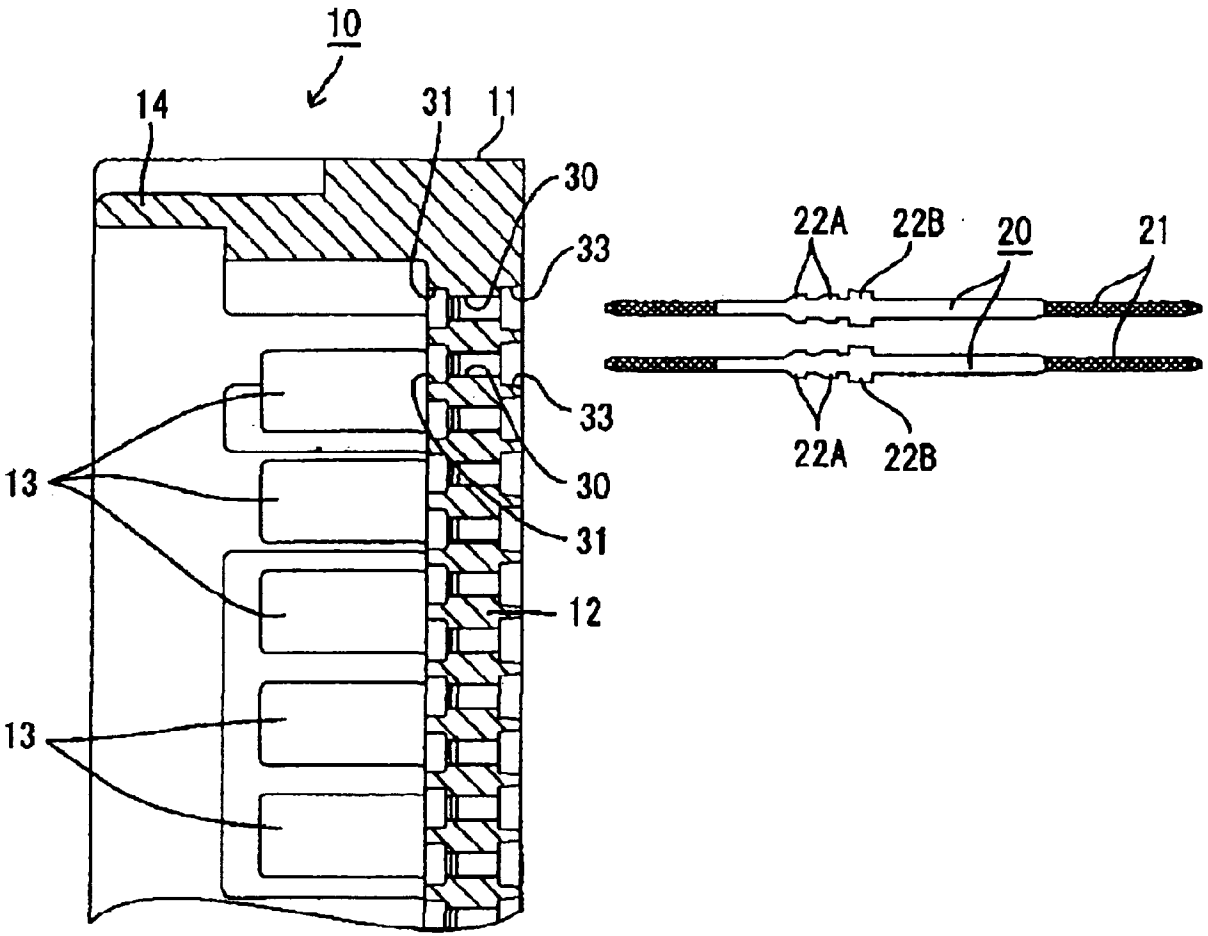
FIG. 5 is a lateral section showing the state before the terminal fittings are inserted through the through holes.
Figure 6:
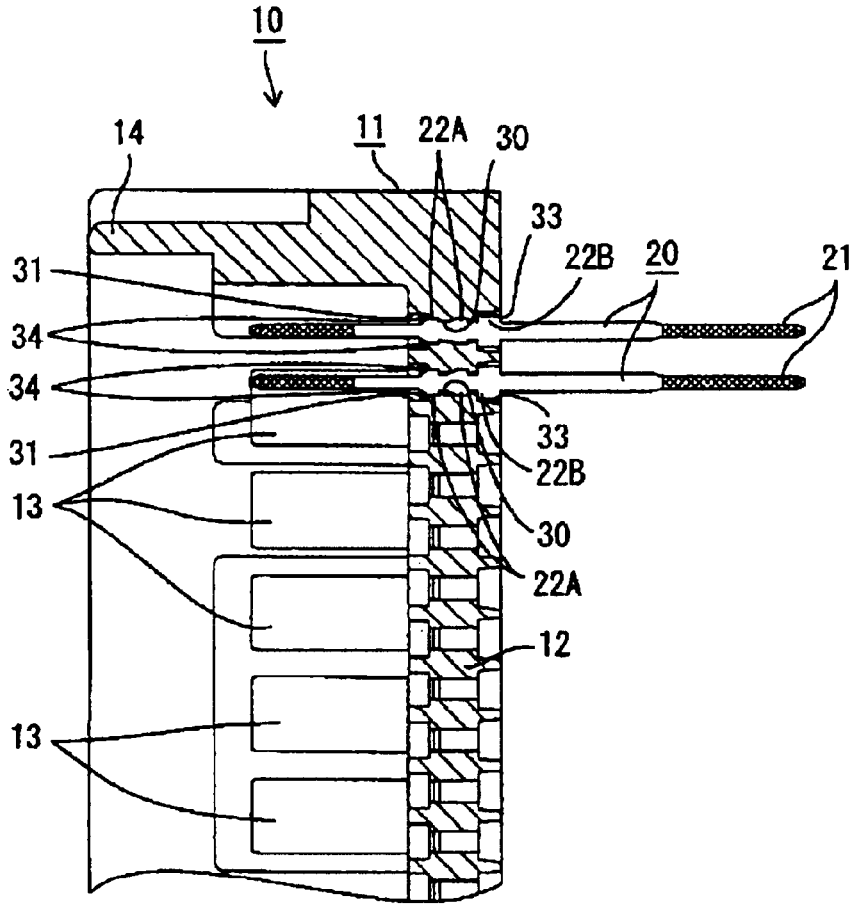
FIG. 6 is a lateral section showing a state where the terminal fittings are inserted through the through holes.

The connector 10 also includes terminal fittings 20, as shown in FIGS. 5 and 6. Each terminal fitting 20 is a long narrow bar having a substantially rectangular lateral cross section. Two pairs of pressing projections 22A are formed near the longitudinal center of the terminal fitting 20 and bulge out in widthwise direction substantially normal to the longitudinal direction of the terminal fitting 20. Each pressing projection 22A has a tapered front side. Further, two substantially rectangular stoppers 22B project behind the pressing projections 22A with respect to an insertion direction ID into the insertion holes 30.

Plating with a material having good electric conductivity properties, such as gold plating, is applied to the opposite ends of each terminal fitting 20 cross-hatched in FIGS. 5 and 6 to ensure a satisfactory electrical connection with an unillustrated mating terminal. The thickness and the width of the plated portions are slightly smaller than the corresponding inner dimensions of the through hole 30.

Figure 1:
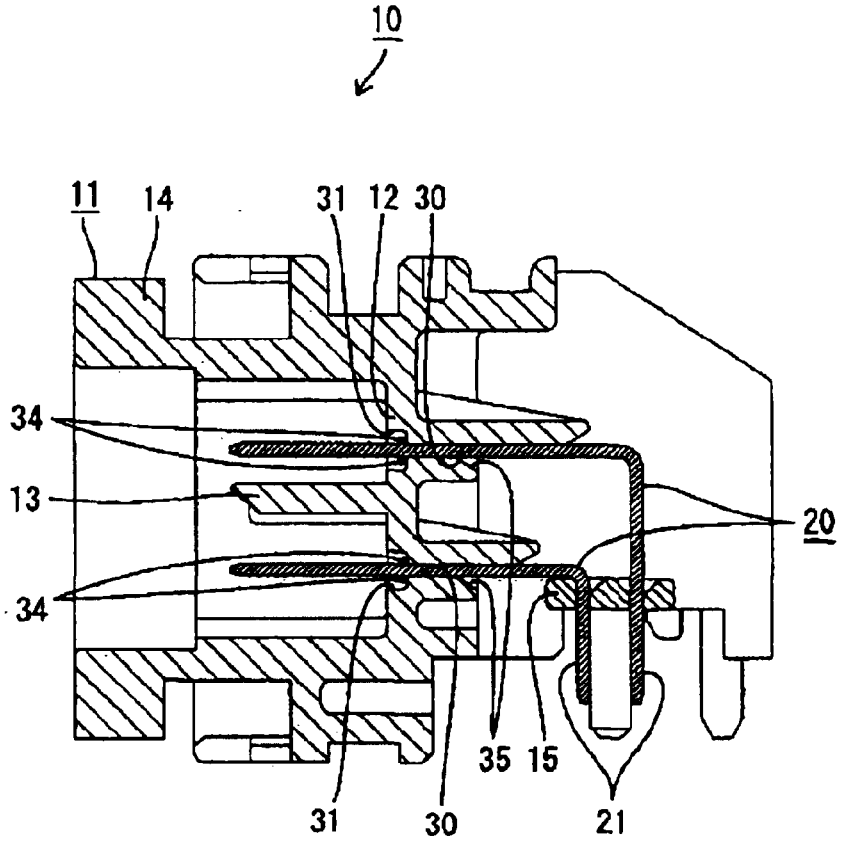
FIG. 1 is a longitudinal section of a connector according to a first embodiment of the invention.
Figure 2:
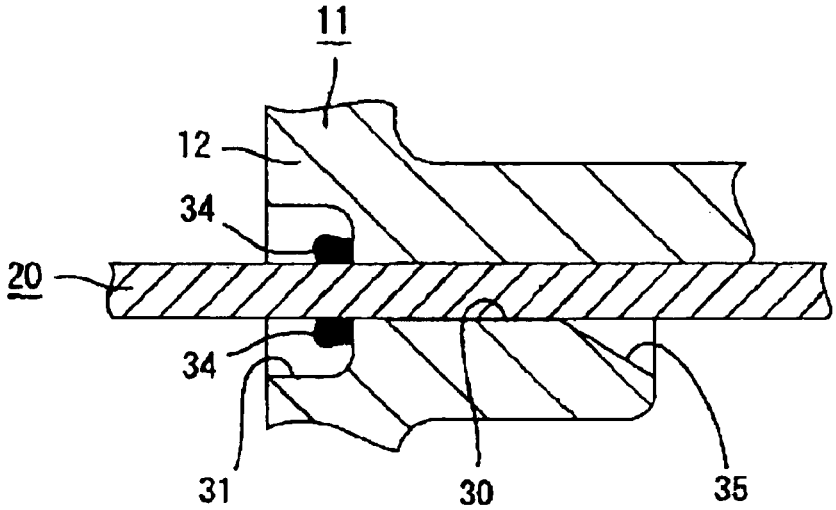
FIG. 2 is a partial enlarged longitudinal section showing a state where a terminal fitting is inserted through a through hole.
Figure 3:
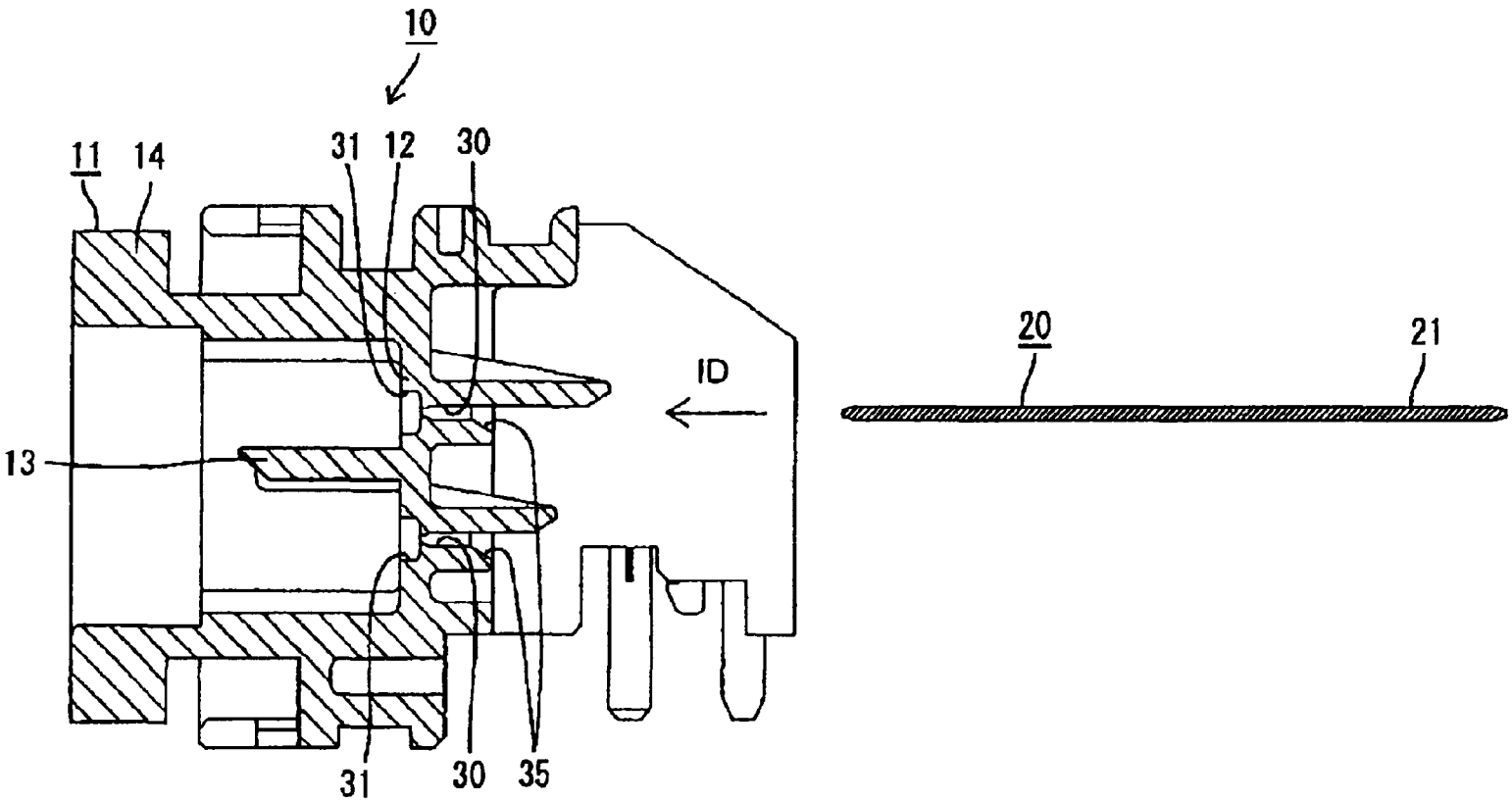
FIG. 3 is a longitudinal section showing a state before the terminal fitting is inserted through the through hole.

The terminal fitting 20 is pressed in the inserting direction ID into the insertion hole 30 in the bottom wall 12 of the receptacle 14 from the rear side of the housing 11, as indicated by the arrow in FIG. 3. At this time, the gold-plated portion at the leading end side of the terminal fitting 20 is inserted without being strongly abraded against the inner surface of the through hole 30.

The portion of the terminal fitting 20 that has the pressing projections 22A is wider than the through hole 30. However, the front sides of the pressing projections 22A are tapered. Thus, the pressing projections 22A bite in the inner wall of the insertion hole 30 and are pressed into the insertion hole while slightly scratching off or deforming the inner wall of the insertion hole 30. The stoppers 22B then enter the stopper receiving portions 33 to prevent any further insertion of the terminal fitting 20 in the inserting direction ID. Consequently the terminal fitting 20 is fixed at a proper position.

End portions of the terminal fittings 20 that project back from the bottom wall 12 are bent down at substantially right angles after the terminal fittings 20 are fixed at the proper positions. The bent end portions then are inserted through an alignment plate 15 and are held while aligned in front and back rows.

The pressing projections 22A are likely to scratch off the inner walls of the through holes 30 when the terminal fittings 20 are pressed into the through holes 30. Thus, chips 34 are produced from the inner walls of the through holes 30 and may be pushed into the receptacle 14 as the terminal fittings 20 are pressed in. However, the recesses 31 are formed in the surface of the bottom wall 12 facing the receptacle 14, and any such chips 34 will stay in the recesses 31. Accordingly, a mating connector (not shown) can be fit into the receptacle 14 until contacting the bottom wall 12, and there will be no connection error or a contact error resulting from the chips 34 squeezed between a connection surface of the mating connector (not shown) and the bottom wall 12 can be prevented.

Figure 7:
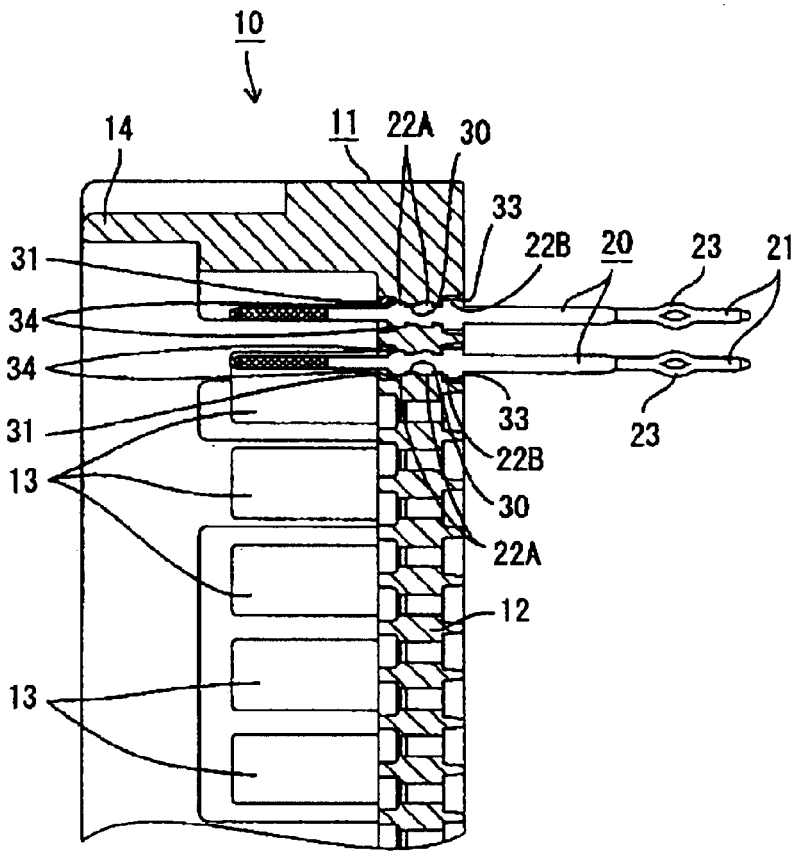
FIG. 7 is a lateral section of a connector according to a second embodiment of the invention showing a state where terminal fittings are inserted through through holes.
Figure 8:
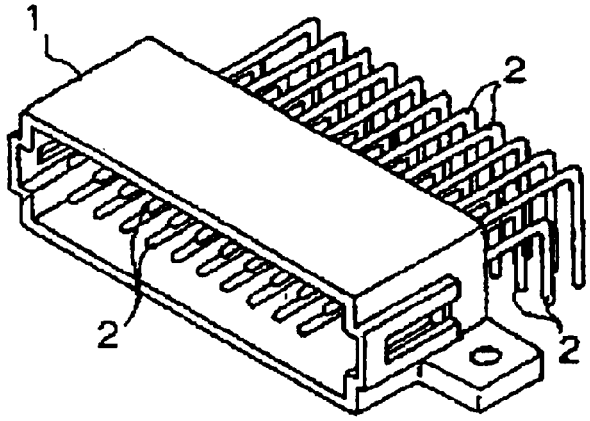
FIG. 8 PRIOR ART
FIG. 8 is a perspective view of a prior art connector.

A second embodiment of the invention is described with reference to FIG. 7. In the second embodiment, a bulge 23 bulges out in widthwise direction at a rear end portion of a terminal fitting 20. A PCB connector 10 of the second embodiment is produced by pressing each terminal fitting 20 into a corresponding through hole 30 in a rear wall 12 of a receptacle 14 from the side of the terminal fitting 20 where the bulging portion 23 is not provided.

The other construction is the same as or similar to the first embodiment, and no repetitive description is given thereon by identifying elements having the same functions by the same reference numerals.

The end portion of each terminal fitting 20 of the second embodiment where the bulge 23 is provided serves as a connection leg 21 and projects down substantially normally from the rear surface of a connector housing 11. The connection legs 21 are pressed into mount holes (not shown)

in a printed circuit board (not shown). Thus, the PCB connector 10 and the printed circuit board (not shown) can be fixed to and electrically connected with each other by the bulges 23. Thus, operation steps such as soldering, welding or the like can be left out, thereby simplifying the production process.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The recesses 31 are exposed to the inside of the receptacle 14 in the foregoing embodiments. However, the invention is not limited thereto. The surface of the bottom wall 12 facing the inside of the receptacle 14 may be closed except the portions through which the terminal fittings 20 are inserted. The terminal fittings 20 then may be held more stably held by the bottom wall 12.

The terminal fittings 20 are inserted while being substantially aligned at upper and lower stages in the rear wall 12 in the foregoing embodiments. However, the terminal fittings 20 may be inserted while being aligned at one or three or more stages in the rear wall 12.

The lateral cross sections of the insertion holes 30 formed in the bottom wall 12 are substantially rectangular in the foregoing embodiments. However, the lateral cross sections may be, for example, circular or oblong.

What is claimed is:

1. A circuit board connector, comprising:

a resin housing with opposite front and rear ends, a receptacle extending into the front end for receiving a mating connector substantially along an inserting direction, the receptacle having a wall aligned substantially normal to the inserting direction and disposed for contacting the mating connector inserted into the receptacle, the wall being formed with at least one through hole for providing communication between areas inside and outside of the receptacle, at least one metal terminal fitting being introduced through the through hole along an the insertion direction from the rear end of the housing towards the front end of the housing, the terminal fitting having at least one pressing portion dimensioned for engaging and biting into portions of the housing defining the through hole, the terminal fitting further having a front portion projecting forward of the wall and into the receptacle, and the wall of the receptacle being formed with at least one recess adjacent the receptacle and widening at least part of inner peripheral surfaces of the through hole, the recess receiving chips produced by introducing the pressing portion through the through hole.

2. The circuit board connector of claim 1, wherein the terminal fitting has a connection leg projecting from the housing, at least one bulge bulging out in a widthwise direction from the connection leg and being insertable into a circuit board.

3. The circuit board connector of claim 1, wherein the pressing portion has a front part that is slanted relative to the inserting direction.

4. The circuit board connector of claim 1, wherein the through hole is located substantially in the center of the corresponding recess.

5. The circuit board connector of claim 1, wherein the terminal fitting comprises a stopper for engaging a corresponding stopper receiving portion of the housing to stop insertion of the terminal fitting into the through hole.

6. The circuit board connector of claim 1, wherein a the front portion of the terminal fitting has outer dimensions smaller than the corresponding inner dimensions of the through hole.

7. The circuit board connector of claim 6, wherein plating is applied to the front portion.

8. The circuit board connector of claim 1, wherein the terminal fitting has a projecting leg projecting back from the housing, the projecting leg being bent substantially normal to the inserting direction.

9. The circuit board connector of claim 1, wherein the at least one terminal fitting comprises a plurality of terminal fittings, the at least one through hole in the wall of the receptacle comprising a plurality of through holes corresponding respectively to the plurality of terminal fittings, the at least one recess comprising a plurality of recesses formed in the wall and disposed such that each of said through holes is located substantially in the center of a corresponding one of the recesses.

10. The circuit board connector of claim 9, wherein each of said through holes is of substantially rectangular cross-section and wherein each of said recesses is substantially rectangular.

* * * * *